United States Patent [19]

Nilsen

[11] Patent Number: 4,702,347

[45] Date of Patent: Oct. 27, 1987

[54] FOLDING, BURGLAR PROOF FIRE ESCAPE LADDER WITH SEPARATE RELEASE STATIONS AND SAFETY BELTS WITH LOCKING BRACKETS

[76] Inventor: Arild Nilsen, Geithusvn., 3370 Vikersund, Norway

[21] Appl. No.: 867,679

[22] Filed: May 28, 1986

[30] Foreign Application Priority Data

Jul. 12, 1985 [NO] Norway ..... 852805
Jan. 28, 1986 [NO] Norway ..... 860294

[51] Int. Cl.[4] ..... E06C 9/12; E06C 1/383

[52] U.S. Cl. ..... 182/8; 182/96; 182/160

[58] Field of Search ..... 182/8, 95, 96, 159, 182/160, 161

[56] References Cited

U.S. PATENT DOCUMENTS

| | | | |
|---|---|---|---|
| 350,047 | 9/1886 | Dunn | 182/96 |
| 378,316 | 2/1888 | Holt | 182/160 |
| 2,957,537 | 10/1960 | Padlo . | |
| 3,439,776 | 4/1969 | Scheerer | 182/160 |
| 3,517,770 | 6/1970 | Loix | 182/96 |
| 3,885,647 | 5/1975 | Acosta | 182/8 |
| 3,968,858 | 7/1976 | Vollan et al. . | |
| 4,037,686 | 7/1977 | Shull | 182/160 |
| 4,130,177 | 12/1978 | Pandolf . | |
| 4,245,717 | 1/1981 | Soucy | 182/96 |
| 4,269,284 | 5/1981 | Swager | 182/8 |
| 4,352,409 | 10/1982 | Fountain | 182/8 |
| 4,401,183 | 8/1983 | Schler | 182/8 |
| 4,463,829 | 8/1984 | Grin | 182/160 |

FOREIGN PATENT DOCUMENTS 7800523-3 7/1978 Sweden .

*Primary Examiner*—Reinaldo P. Machado
*Attorney, Agent, or Firm*—Wenderoth, Lind & Ponack

[57] ABSTRACT

A folding fire-escape ladder with safety belt, made of two U-shaped channels (A,S), which form the side rails, and rungs (W) of square tubing. The rungs are attached to the side rails by articulated joints. The ladder has a burglar proofing device on the top (J,K). One or more separate release points at escape stations can be installed by sawing through the outer rail (A) to form at least two sections thereof and by fixing a release bracket (O) to a section of the outer rail (A) above the cut. The release bracket (O) has a collar (R) which replaces the material removed by the saw. Joining the upper and lower sections of the outer rail (A) at the release point-/escape station is achieved by a locking plug (K) which is fitted through axially aligned holes in the outer rail (A) and the release bracket (O). A safety belt (E) is attached to the outer rail (A) by a locking bracket (B) which is threaded onto the outer rail (A) either from the top, or through a threading slot (G) at the escape station which corresponds to the width of the locking bracket (B). The widest locking bracket (B) is placed at the top escape station and the threading slots (G) become sequentially narrower at lower escape stations to enable the locking bracket (B) to slide over the threading slots therebelow. The rungs (W) lock against unfolding beyond 90° since their ends engage against the walls of the side rail sections (A,S). Wall fixing brackets (P) are shaped to fit the inner rail (S) and are fixed thereto by the same bolt fixtures connecting the rungs (W) to the side rails (A,S), to thereby stabilize the ladder against lateral movement.

9 Claims, 19 Drawing Figures

FOLDING, BURGLAR PROOF FIRE ESCAPE LADDER WITH SEPARATE RELEASE STATIONS AND SAFETY BELTS WITH LOCKING BRACKETS

BACKGROUND OF THE INVENTION

1. Field of the Invention

This invention relates to a folding (collapsible) fire-escape ladder of metal which, in the normal state, is folded, and thus burglar proof but which, in the event of fire, can be unfolded by a simple manual operation from each escape station to form a fire-escape ladder which reaches right down to the ground and which is equipped with guides for brackets and safety belts.

The safety belt is secured to one of the ladder side rails by means of its locking bracket. These brackets are so designed that, when unloaded, they slide down the side rail but, when loaded with the weight of a person (irrespective of size) they lock onto the side rail, thus preventing the person from falling off the ladder.

As will be known, certain safety requirements are demanded in connection with fire-escape routes for houses with two or more stories. This problem is often solved by such means as fire-escape ropes, rope ladders, or a robust ladder with safety hoops permanently fixed on the outside of the building.

Rope climbing requires training, and it is too late to consider this aspect once a fire has started. Climbing on a swinging rope ladder requires good physical condition and also strong nerves, while the safety of permanently fixed fire-escape ladders, with safety hoops, can be open to question, should a person, in a state of panic, lose a handhold or foothold. In such instances, there is a real risk of falling down through the ladder, as in a shaft. Furthermore, such ladders are eyesores on house fronts.

2. Description of the Prior Art

Various types of fire escape ladders are known.

The ladder described in U.S. Pat. No. 4,245,717 is made in separate sections for each floor of a building. In an escape situation, the occupant of the upper floor of the house must first release his own ladder section. When he has climbed out onto this section he must then release the ladder section in the floor below. This he does either by bending down while holding fast with one hand, to release the next ladder section, or he searches with his foot to find the release device.

This is the manner in which the escaping person must proceed, floor by floor, or ladder section by ladder section. It is obvious that such a descent is risky, and particularly so if it is dark and the person has to fumble around to find the release device at each floor. Further, this ladder has several cross struts between the steps which must impede descent. In addition, the ladder has no safety arrangement to prevent falling should a person lose one's handhold or foothold.

U.S. Pat. No. 3,414,081 describes a collapsible ladder with a release arrangement at the top of the ladder. To this release arrangement there is fixed a cord. If the ladder is to be used by the occupants of a house with several floors, it must be possible for the occupants of all the floors to reach this cord. As a result, the ladder is no longer burglar proof. If the cord were to be removed, the ladder would not be of any use as an escape route for houses with several floors should the occupant of the top floor not be at home or should find it impossible to release the ladder in the event of fire. Also, this ladder does not have any arrangement which protects users from the danger of falling off.

U.S. Pat. No. 4,243,119 discloses a collapsible ladder without any form of burglar-proofing. It is held in position in the extended state by means of an articulated hinge. If such a ladder were to be used by several persons at the same time, the hinge at the top would be subjected to a heavy load. The risk of material failure in connection with the hinge is thus present and, if this were to occur, all the persons would find themselves stuck on the ladder as in a trap. Also this ladder lacks safety arrangements to protect users from falling off.

SUMMARY OF THE INVENTION

The new folding fire-escape ladder, according to the present invention, achieves the following features:

(1) No limit to the number of floors the ladder can serve simultaneously.

(2) Security against unauthorized traffic into the house, in that the ladder can only be released either from the top or from the other floors, but not from the ground.

(3) The occupants of any floor can release the ladder from their respective escape stations so that it reaches right down to the ground.

(4) The user is secured against falling off the ladder by means of a safety belt with a locking bracket.

(5) A feeling of greater safety when entering the ladder from an escape station high above the ground.

(6) The ability to lower a disabled or unconscious person down the ladder side rail by means of a safety belt with locking bracket and control lever.

(7) Steady and safe descent by means of the wall fixing brackets which stabilize the ladder against lateral movement.

These features are achieved, according to the invention, in that the ladder steps are attached to the side rails by means of a bolt which produces an articulated connection. The side rails consist of two U sections (channels) disposed with their flanges facing one another. Each of these sections has a flange protruding from the bottom of the U on both sides.

The side rail nearest the wall (hereinafter called the inner rail) also has an external little flange protruding from the top of the U, on both sides, which closes over the outer rail when the ladder is folded.

The ladder is fixed to the wall by means of fixing brackets shaped to accommodate the inner rail. The inner rail is fixed to these brackets by means of through-going bolts which also hold the rungs in position. This method of fixture simultaneously stabilizes the ladder against lateral movement when in use.

The rungs consist of square tubing which fits into the two sections which make up the side rails. When the rungs are opened out to 90° relative to the side rails, the ladder is locked against the walls in the side rail sections. The walls of the rungs are thicker around the bolt holes.

When the ladder is folded together, the outer rail is held in position by a box-shaped member with the bottom up (hereinafter called the locking cap), which is threaded over both side rails. To guard against the possibility of this locking cap being tipped off by means of some object from below, it is secured with a locking plug with a spherical handle, inserted through a hole in the cap and the outer rail. As a further security against the removal of this locking plug by unauthorized persons from below, it is so designed that a certain amount of force is required to withdraw it.

When the ladder is to be used from the uppermost point, the locking plug is withdrawn, the locking cap removed and the ladder will then open out by its own weight.

When the occupants of several floors in a building, for example, a hotel or a block of flats, are to use one and the same ladder as an escape route, there would be installed separate release points at each escape station wherefrom the ladder can be released right down to the ground. For such requirements, the ladder would be built in the following manner:

From a standard program of different ladder lengths, sufficient pieces of predetermined length are selected to make up the total length required. (The ladder lengths are joined together on site to form a continuous ladder by means of a joining bracket which is not described in further detail). At each escape station, the outer rail is cut through into sections of preselected lengths corresponding to the locations of the escape stations, and then a release bracket forming part of a release means is threaded onto the outer rail above the cut and riveted into position. In the outer rail below the cut a hole is drilled in line with the hole in the release bracket.

A locking plug forming another part of the release means is inserted through the hole in the outer rail and the hole in the release bracket, thus joining the outer rail together to form one continuous piece again.

In an escape situation, the occupants of any floor will be able, independently of occupants above or below, to open the ladder from their escape station, and climb down to the ground. The principle is thus that whoever is the first to open the ladder from their escape station will release it from their escape station down to the ground.

Each time a release means located at a new escape station in the floors above is opened, the released ladder section will join onto the already opened ladder therebelow.

The release bracket has a lower end which is slightly tapered to guide the joining operation with the upper end of an adjacent lower section of the outer rail and a collar is provided on the release bracket which extends between the ends of the adjacent sections of the outer rail to replace the material which was removed by the saw during cutting of the outer rail into sections.

The safety belt is adjustable, and is tied around the waist. Attached to it is a strap with an adjustable buckle. The buckle, in turn is fixed to a locking bracket which is shaped to fit the outer rail, dimensioned with sufficient tolerance to enable it to slide easily down the rail. When the locking bracket is subjected to the weight of a person, it becomes locked to the side rail by means of its torsional moment.

When a person is to enter the ladder from an escape station, for example a window, the safety belt is first tied around the waist, and then the locking bracket is threaded into a groove in the outer side rail. This operation is performed prior to when the escaping person climbs out onto the ladder.

If the ladder is entered from the highest escape station, the locking bracket is threaded onto the side rails from the top.

If the ladder is entered after it has been released from a floor above, the locking bracket is threaded onto the side rail through a punched-out slot (threading slot) in the flange in the outer rail, which slot is the right size for the locking bracket at this escape station. The locking brackets have different widths, the locking bracket for the uppermost escape station being the widest, and the brackets for each escape station below becoming sequentially narrower. Color coding, numbering, or some similar arrangement ensures that the appropriate safety belts will always be placed on the right floor.

Should an unconscious or a disabled person need to be lowered down the ladder, this is achieved in that the person is fitted with a safety belt with a locking bracket equipped with a control lever. After the person has been lifted out and secured to the ladder by means of the safety belt, an assistant enters the ladder from the opposite side and releases the locking bracket by means of the control lever. By releasing and tightening the control lever (like a jack) the person concerned is lowered down along the side rail at a controlled speed.

BRIEF DESCRIPTION OF THE DRAWINGS

The invention will now be described in more detail with reference to the attached drawings, in which.

DETAILED DESCRIPTION OF THE PREFERRED EMBODIMENTS

Figure 1:
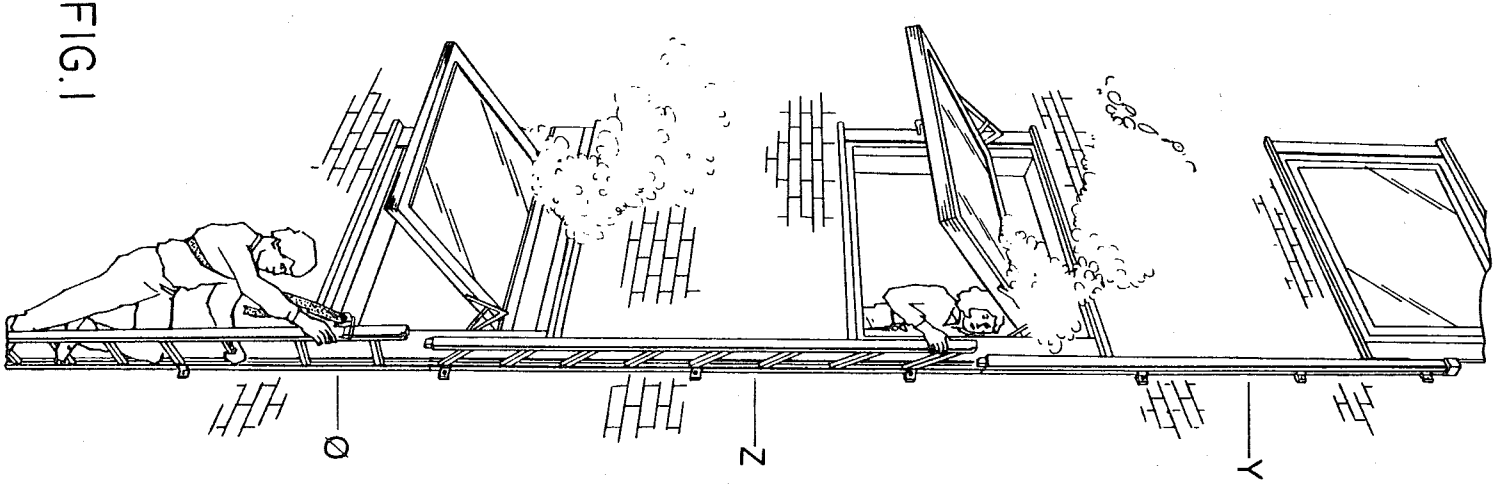
FIG. 1 shows the folding ladder in three different stages.

FIG. 1 shows the multi-section ladder in use, in which Y illustrates a portion of the ladder in the closed or non-useable condition, Z shows a portion of the ladder half unfolded by means of a release device at an escape station, and Ø shows a portion of the ladder fully open and in a useable condition with a safety belt attached thereto.

Figure 5C:
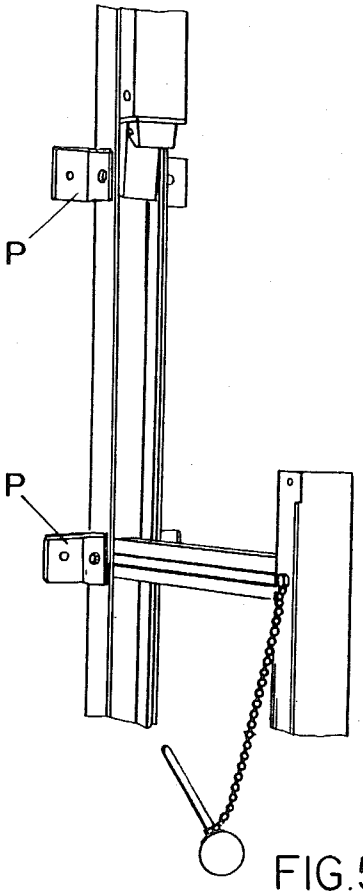
FIGS. 5*a–c* illustrate the method by which the side rail is fixed to the wall, and how the rungs are hinged.
Figure 5B:
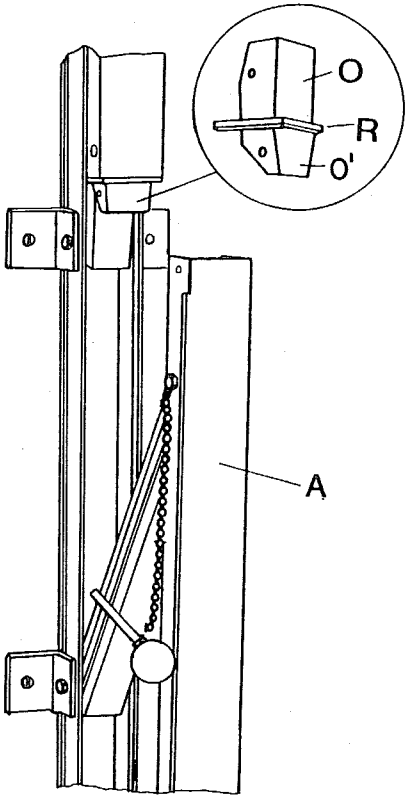
Figure 5A:
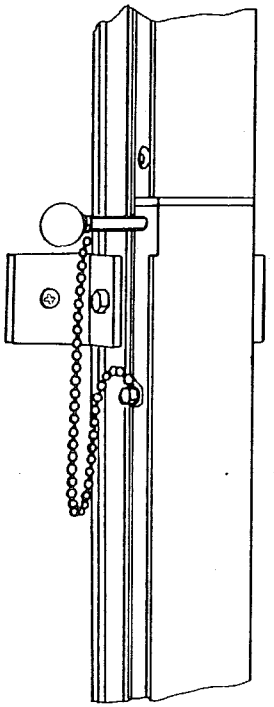
Figure 10A:
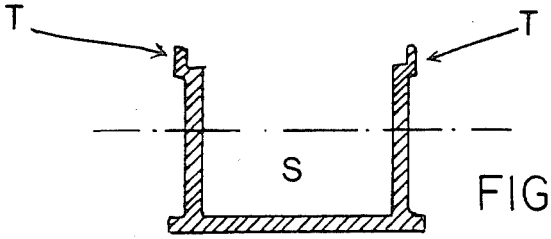
FIGS. 10*a* and *b* show how the wall fixing bracket and the inner rail are oriented with respect to one another.
Figure 10B:
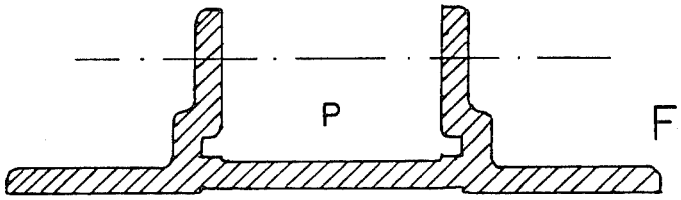
Figure 11A:
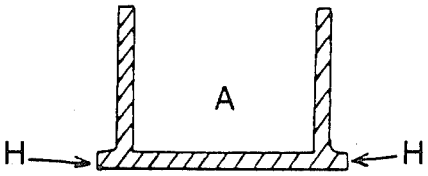
Figs. 11*a* and *b* show how the outer rail and a locking bracket are oriented with respect to one another.
Figure 11B:
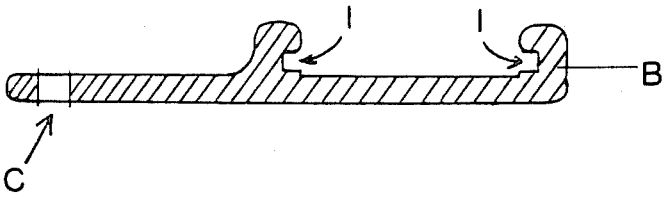

The fire-escape ladder is made of metal and comprises side rails of U-shaped channels, each channel comprising a flat bottom wall with spaced-apart side flanges extending perpendicularly therefrom, with rungs W pivotally attached between the spaced-apart flanges by means of bolts. FIGS. 5*a–c* show an escape station on the ladder below the top floor, in which FIG. 5*a* shows the release point in the closed state, while FIG. 5*b* shows the ladder half opened from the release point, and FIG. 5*c* shows the ladder fully opened at the release point. One of the side rails forms the outer rail A which extends in a longitudinal direction and is hinged to the inner rail S by means of the rungs W, and the channel forming the inner rail S on its outer sides, near the bottom of the U-shaped channel, has flanges extending perpendicularly from the side flanges which fit into opposite grooves formed in wall brackets P, while on the edges of the side flanges there are more widely spaced-apart smaller flanges T which overlap the side flanges of the outer rail A when the ladder is in a folded non-useable condition. The channel forming the outer rail A, at the bottom of the channel, has smaller outwardly extending flanges H which fit within opposite grooves I formed in a locking bracket B. FIG. 11*a* shows the outer rail A in section, and FIG. 11*b* shows the locking bracket B in section, while C indicates the fixture point for an adjustable buckle F of a safety belt E. The flanges H on the outer rail A are adapted to be fitted in grooves I formed in the locking bracket B. FIG. 10*a* shows the wall fixing bracket P and together with FIG. 10*b* shows how the inner rail S is oriented with respect to the bracket P, while T indicates a flange on the inner rail S, which is designed to close over the outer rail A when the ladder is folded into a non-useable condition by moving the outer rail A into contact with the inner rail S.

The outer flange A is adapted for the required number of escape stations by being cut therethrough at the points corresponding to each escape station to thereby form a plurality of sections separated from each other in the longitudinal direction by a small gap. A release bracket O is fitted in the space formed between the side walls and bottom of a section at the lower end thereof. The release bracket O is fixed by suitable means such as riveting to the lower end of a section of the outer rail and a collar R is provided on the release bracket O to abut the lower end of the section, the collar R sized to fill the small gap by replacing the material which was removed by cutting the outer rail at the respective escape station.

Each escape station on the ladder is provided with release means comprising a locking plug K which fits into a hole in the upper end of a lower section of the outer rail A for releasing engagement between the release bracket O and a lower section of the outer rail A, which hole is in axial alignment with a corresponding hole in a portion O' of the release bracket O which extends below the lower end of an upper section of the outer rail. The portion O' fits within the space formed by the side flanges and bottom of the upper end of the lower section of the outer rail when the upper and lower sections are aligned with each other. However, the lower section can be pivoted out of alignment with the upper section once the locking plug K is removed from the hole in the release bracket. FIG. 5*b* shows the release bracket O of the release means mounted on the outer rail A. The drawing in the circle illustrates this more clearly. This drawing shows that the bracket is tapered at the end to facilitate insertion into the lower section of the outer rail A. The same detailed drawing also shows that the release bracket O has a collar R designed to replace the material which was removed when the outer rail A was cut into two adjacent sections.

Figure 7:
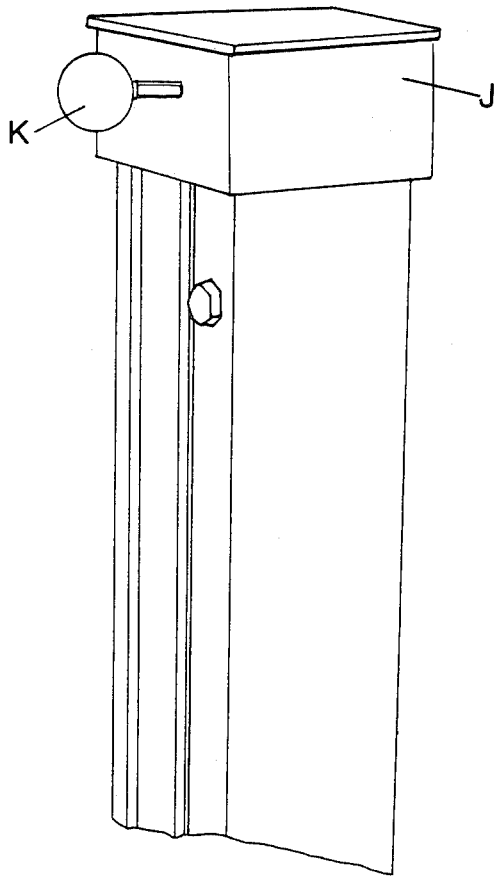
FIG. 7 illustrates the locking cap over the rails.

The outer rail A is locked to the inner rail S by means of a locking cap J associated with an uppermost one of the sections and an upper end of the inner rail and a locking plug K removably fitted in axially aligned holes in the outer rail and the locking cap J. FIG. 7 illustrates how the ladder is made burglar proof by means of the locking cap J and the locking plug K.

The ladder is stabilized against lateral movement, when in use, by means of the fixing brackets P which have a pair of flanges shaped to receive the inner rail S therebetween and fixed thereto by the same bolt fixture as for rungs W. FIG. 5*c* shows the wall fixing brackets P fitted between the wall of a building and the inner rail at positions adjacent the rungs above and below the release point to stabilize the ladder against lateral movement.

Figure 8:
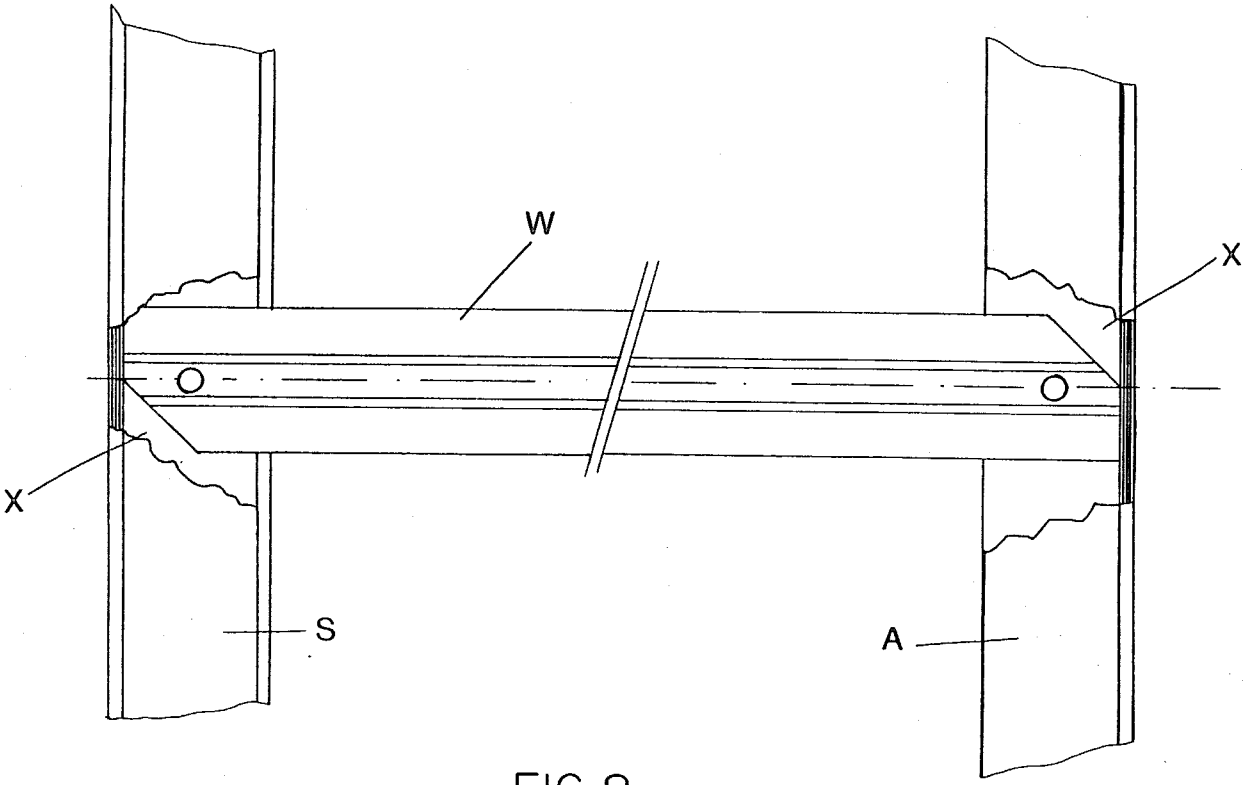
FIG. 8 depicts a rung in the open position.
Figure 9:
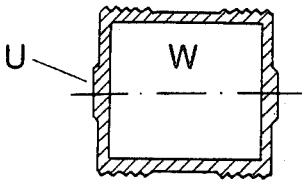
FIG. 9 is a cross section of a rung.

FIG. 8 shows how rung W stops the unfolding action of the ladder when it has reached a position of 90° with respect to rails A and S. Further, the ends of the rungs are cut obliquely at X such that a portion of the rung is removed along the length thereof up to the center line of the bolt hole through which a bolt joins the rung to one of the rails. The rungs W have opposite ends which abut the inner and outer rails when the ladder is a useable condition and have a pair of parallel oblique cuts X, each extending from an end thereof at a 45° angle up to the center line of the bolt holes, to enable the ladder to be self-locking against further unfolding movement when the rungs have been opened 90° with respect to rails A, S. FIG. 9 is a cross-section of a rung which forms a step W, showing that the walls are thicker (reinforced) at a portion U around the bolt holes.

Figure 3:
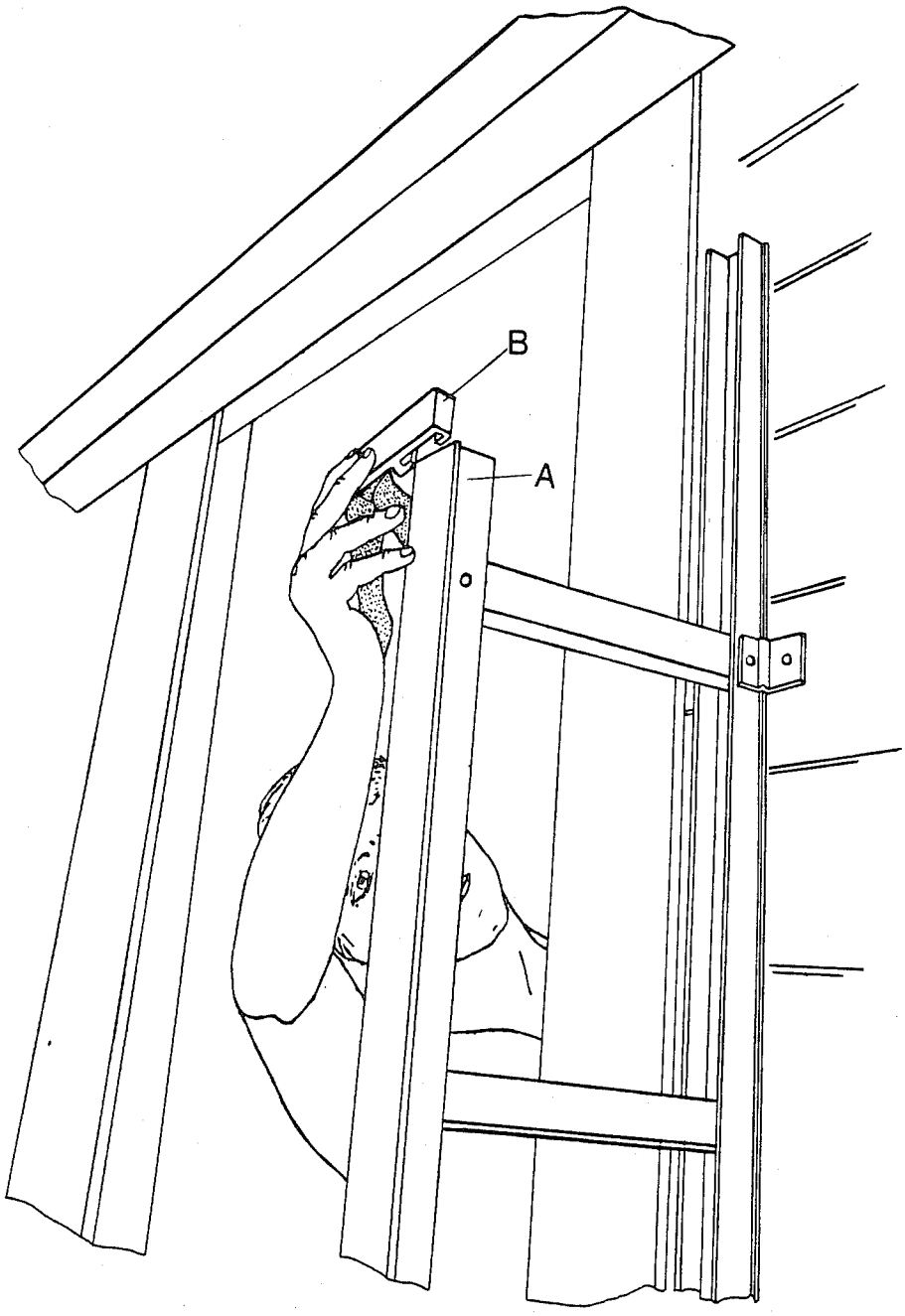
FIG. 3 illustrates the method of threading the safety belt bracket onto the ladder at the uppermost escape station.
Figure 4:
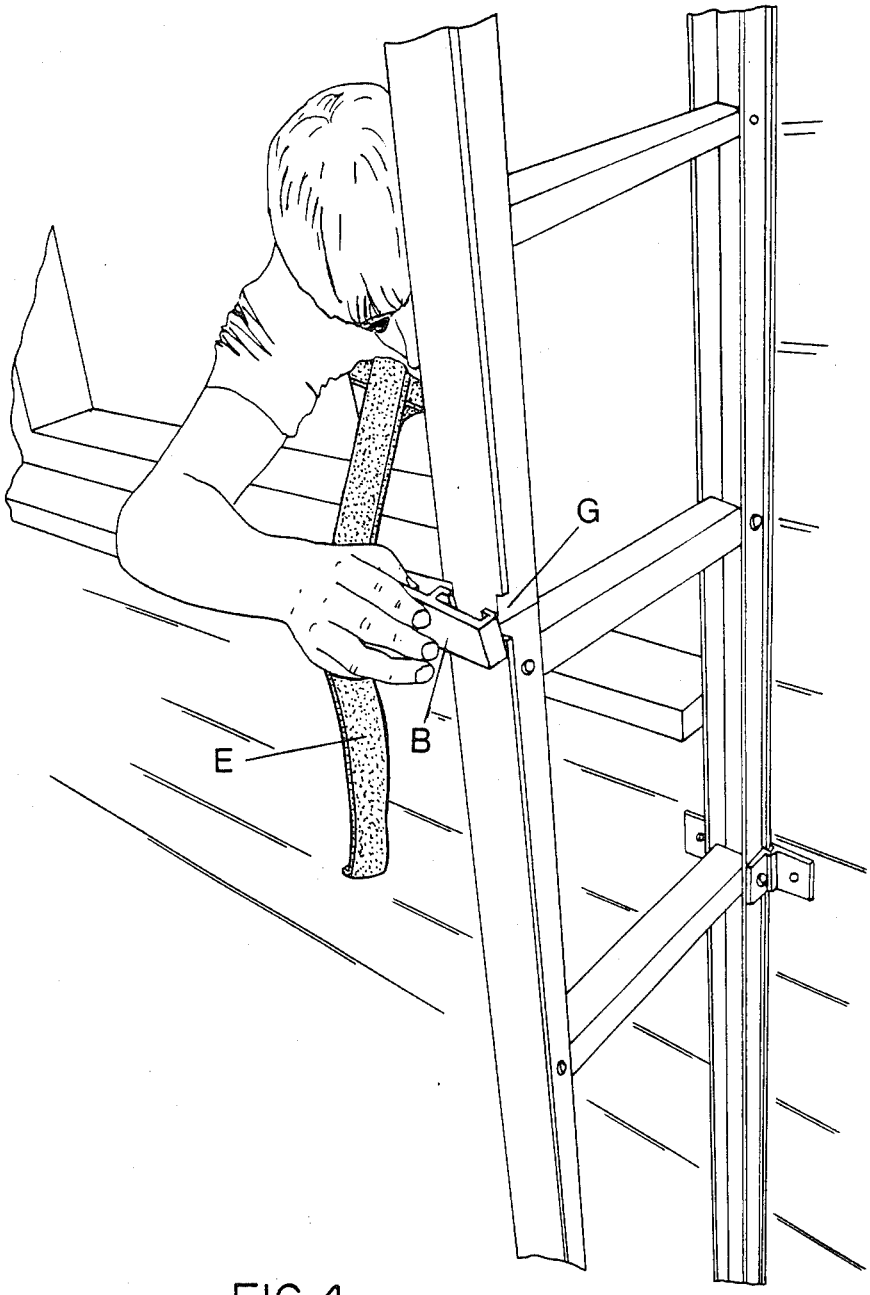
FIG. 4 shows how the safety bracket is threaded onto the ladder from an intermediate escape station.
Figure 6:
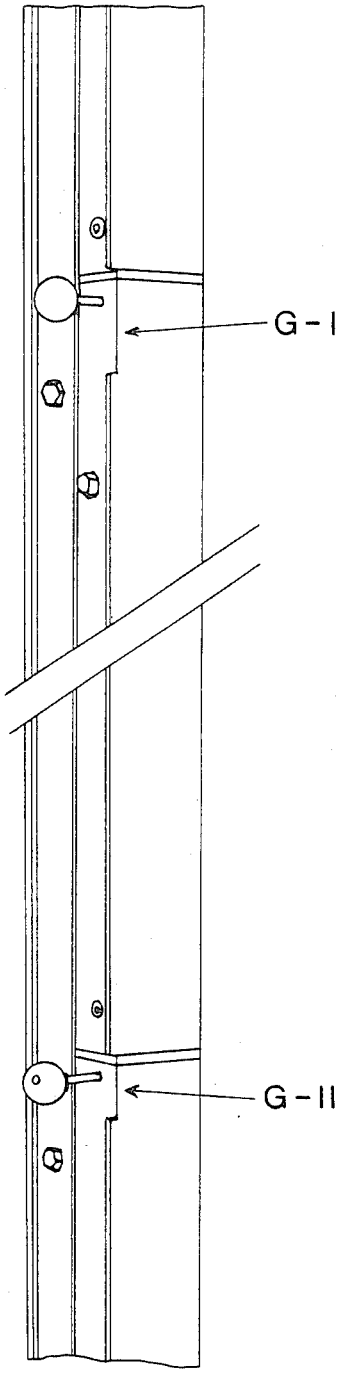
FIG. 6 illustrates the differences in the widths of the threading slots at different escape stations.

In FIG. 6 G-I and G-II illustrate the different widths of threading slots G at the upper and lower escape stations, so that the locking bracket B will not be able to fall out through the lower slots, such as at G-II as it slides down the ladder. The threading slots G in the side flanges on the outer rail A for the locking brackets B have different widths at each escape station, the uppermost slot being the widest, with the width of the slots G being reduced sequentially at each of the escape stations below the uppermost slot. FIG. 4 shows how the safety belt E, with locking bracket B, is threaded onto the outer rail A through the threading slot G on the ladder after the ladder has been opened from a floor above. The locking brackets B are sized to correspond to the respective width of the threading slot G at the appropriate escape station, whereby each locking bracket B can slide over the slots in each lower escape station without derailing or disengaging from the outer rail. FIG. 3 shows how the locking bracket B is threaded into a slot G in the outer rail A, either from the top or from the highest released escape station on the ladder.

The locking bracket B has sliding grooves I which slidingly engage flanges H formed on the outer rail A. An extension is formed on the locking bracket B forming a fixing lug with a hole C for holding an adjustable buckle F of a safety belt E.

Figure 2:
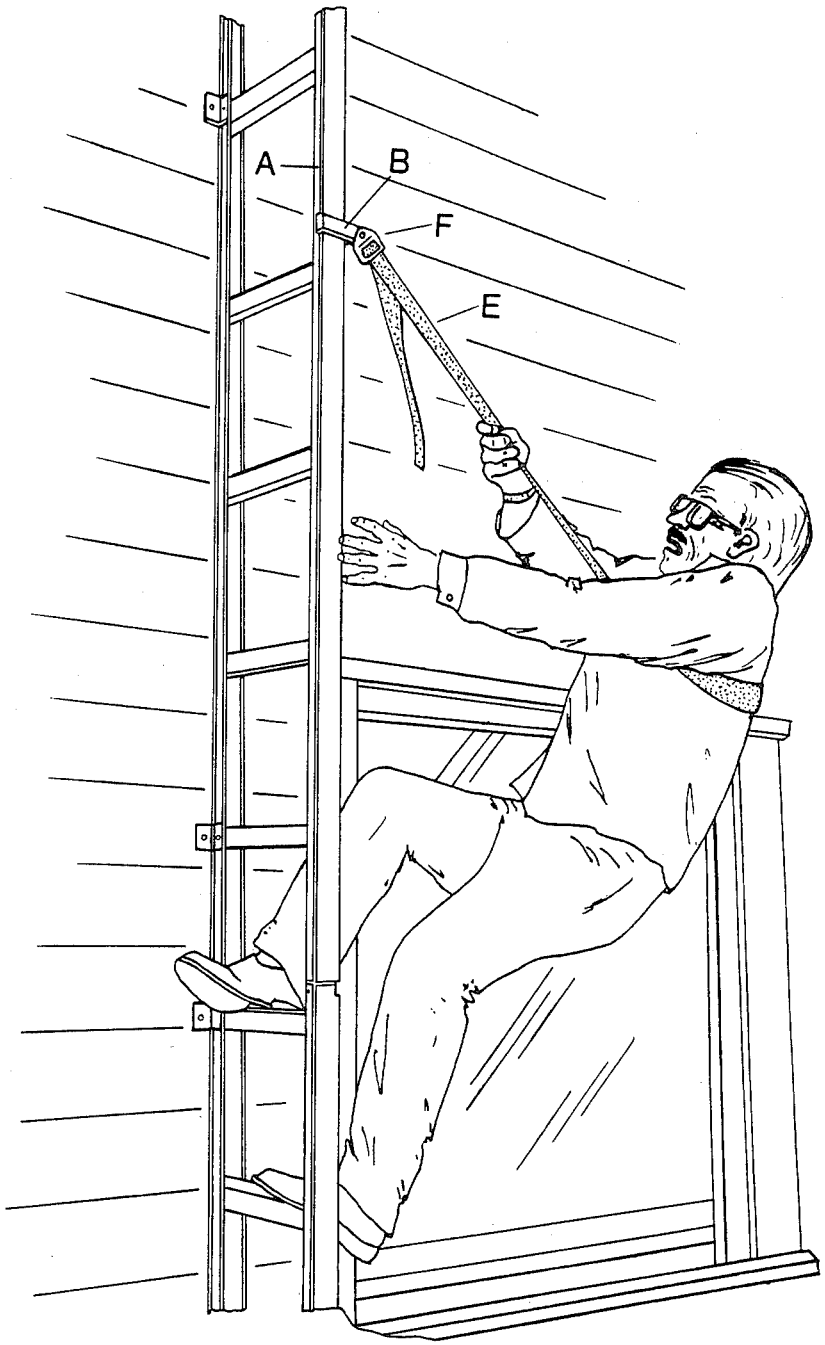
FIG. 2 shows the ladder open and in use.

A load applied at fixing point or hole C for the safety belt F imparts a torsional moment on the locking bracket B on account of deliberate or preset tolerances between the flanges H on rail A and the grooves I in the locking bracket B, thus producing a locking effect in the direction of the load. FIG. 2 shows how a locking bracket B is locked onto an outer rail A in a fall situation with a safety belt E and a buckle F in use.

Figure 12A:
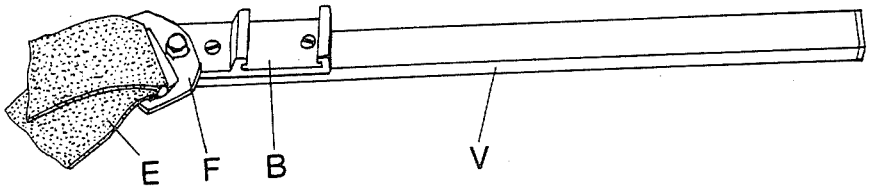
FIGS. 12*a* and *b* illustrate a locking bracket with a control lever.
Figure 12B:
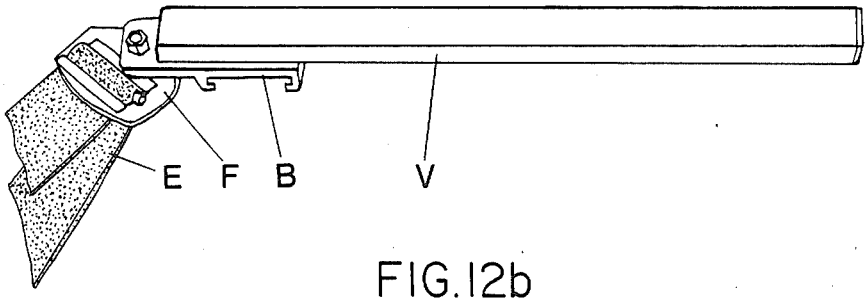

The locking bracket B can be provided with a control lever V attached thereto for use when lowering a disabled or unconscious person in the safety belt E. FIG. 12*a* shows the front and FIG. 12*b* shows the back of the locking bracket B with the control lever V extending therefrom.

Figure 13B:
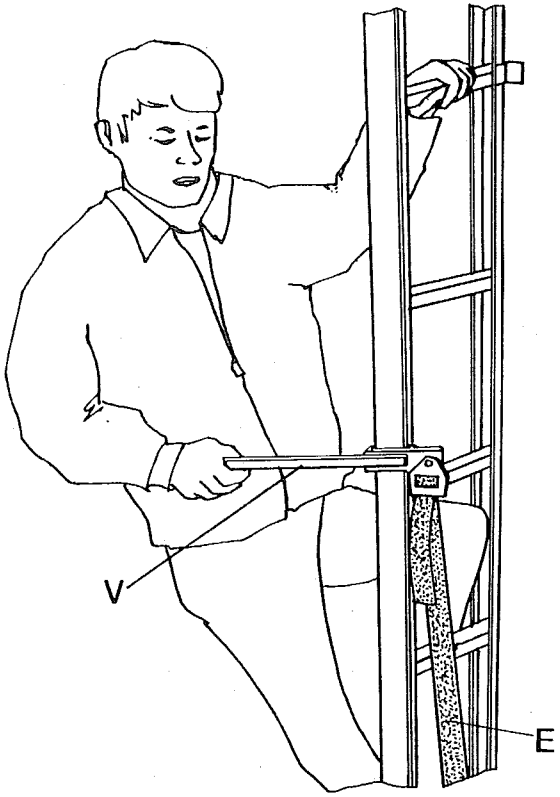
FIGS. 13*a* and *b* show the control lever being used like a jack.
Figure 13A:
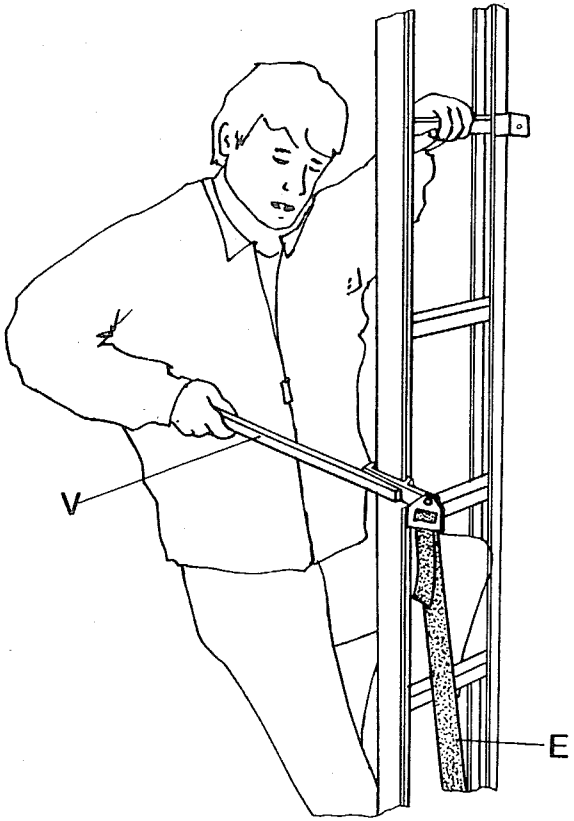

The equipment according to the invention, that is, the folding fire-escape ladder, the locking bracket and the safety belt with the control lever, furnishes a method of saving a disabled person, in that an assistant operates the control lever which, similar to the action of a jack, tightens and slackens the locking bracket B, whereby the person in the safety belt E can be lowered down along the outer rail A at a control speed by pushing down on the control lever V. FIGS. 13*a* and 13*b* show how the control lever V is used as a jack for lowering an unconscious person in safety belt E.

Although the present invention has been described and illustrated with reference to the foregoing embodiments, it is to be understood that various modifications and changes may be made to the specifically described and illustrated features without departing from the scope of the present invention.

I claim:

1. An escape ladder which can be mounted in a non-useable condition on the side of a building and which can be placed into a useable condition from any one of a plurality of escape stations in the building located alongside said ladder, said ladder comprising:

an inner rail extending in a longitudinal direction and adapted to be fixedly secured to the side of a building, said inner rail having a length sufficient to extend between at least two vertically spaced-apart escape stations in the building;

a plurality of rungs, each of which is pivotally connected at one end thereof to said inner rail;

an outer rail extending in said longitudinal direction and parallel to said inner rail, each of said rungs being pivotally connected at the outer end thereof to said outer rail, said outer rail being divided into at least two sections which are movable towards and away from said inner rail to allow use of said ladder when at least one of said sections is moved away from said inner rail; and release bracket means associated with said outer rail for detachably connecting said at least two sections together, said release bracket means when actuated being operable to detach said at least two sections such that a lower one of said two sections moves away from said inner rail, whereby said ladder can be used by a person at an escape station positioned adjacent said release bracket means when said person actuates said release bracket means.

2. The escape ladder of claim 1, further including bracket means for attaching said ladder to a building, said bracket menas comprising a plurality of brackets, each of which has a pair of grooves which receive flanges disposed on said inner rail, each of said brackets also having a pair of flanges which receive said inner rail therebetween, said rungs being pivotally connected to said inner rail by means of a bolt which extends through said pair of flanges, said inner rail and a respective one of said rungs.

3. The escape ladder of claim 1, wherein said inner rail and said outer rail have a U-shaped cross-sectional shape formed by a pair of spaced-apart side flanges extending perpendicularly from a flat bottom wall, said inner rail further including another pair of more widely spaced-apart flanges extending from the outer edges of said side flanges, said another pair of flanges overlapping said side flanges of said outer rail when said ladder is collapsed into a non-useable condition by moving said outer rail into contact with said inner rail.

4. The escape ladder of claim 1, wherein said sections of said outer rail are separated from each other in said longitudinal direction by a small gap, said release bracket means including a release bracket fitted to the lower end of at least one of said sections, said release bracket including a collar sized to fill said small gap, said collar abutting the lower end of an upper one of said sections and an upper end of a lower one of said sections when said upper and lower sections are aligned in said longitudinal direction, said release bracket further including a portion which extends below the lower end of said upper section for guiding said upper section into alignment with said lower section, said release bracket means further including release means for releasing engagement between said release bracket and said lower section, said release means comprising a locking plug removably fitted in axially aligned holes through said release bracket and said lower section, whereby said locking plug can be manually removed to allow said lower section of said ladder to move away from said inner rail thereby permitting use of a lower portion of said ladder.

5. The escape ladder of claim 1, further comprising a locking cap associated with an uppermost one of said sections and an upper end of said inner rail, said locking cap detachably connecting said inner rail to said outer rail by means of a removable locking plug fitted in axially aligned holes in said locking cap and said outer rail.

6. The escape ladder of claim 1, wherein said rungs include ends which abut said inner and outer rails when said ladder is in a useable condition and said rungs include a pair of a parallel oblique cuts, each of said cuts extending at a 45° angle from one of said ends, whereby said ends abut said inner and outer rails when siad outer rail is moved away from said inner rail to place said ladder in a useable condition.

7. The escape ladder of claim 1, further including safety belt means for preventing a user of said ladder from falling therefrom, said safety means including locking brackets adapted for connection to safety belts and means on said ladder for slidably receiving said locking brackets, said means for receiving said locking brackets comprising flanges on said outer rail and threading slots in said flanges for slidably fitting each of said locking brackets over said flanges, said threading slots being progressively wider in said longitudinal direction at each successively higher escape station and said release brackets being correspondingly wider in said longitudinal direction at each successively higher escape station whereby one of said release brackets slidably fitted over said flanges at an upper escape station will not disengage from said flanges when passing over said threading slots located at a lower escape station.

8. The escape ladder of claim 7, wherein said locking brackets each include grooves for receiving said flanges, said grooves being sized to prevent said locking brackets from sliding along said flanges when a load is placed on said locking brackets.

9. The escape ladder of claim 8, wherein at least one of said locking brackets further includes a control lever attached thereto for controlling the descent of a disabled person attached to a safety belt connected to said locking bracket by an assistant who operates said control lever to allow said locking bracket to slide along said flanges.

* * * * *

UNITED STATES PATENT AND TRADEMARK OFFICE

CERTIFICATE OF CORRECTION

PATENT NO. : 4,702,347

DATED : October 27, 1987

INVENTOR(S) : Arild Nilsen

It is certified that error appears in the above—identified patent and that said Letters Patent is hereby corrected as shown below:

In the Title of the Invention, change "Burglar Proof" to --Burglar Tamper Resistant--.

Signed and Sealed this

Twenty-first Day of March, 1989

*Attest:*

DONALD J. QUIGG

*Attesting Officer*

*Commissioner of Patents and Trademarks*